US011715447B2

(12) United States Patent
Greenlee

(10) Patent No.: US 11,715,447 B2
(45) Date of Patent: Aug. 1, 2023

(54) SPONTANEOUS AUDIO TONE INDUCING SYSTEM AND METHOD OF USE

(71) Applicant: Jonathan Edward Greenlee, Saint Paul, MN (US)

(72) Inventor: Jonathan Edward Greenlee, Saint Paul, MN (US)

( * ) Notice: Subject to any disclaimer, the term of this patent is extended or adjusted under 35 U.S.C. 154(b) by 227 days.

(21) Appl. No.: 17/198,213

(22) Filed: Mar. 10, 2021

(65) Prior Publication Data

US 2022/0293074 A1 Sep. 15, 2022

(51) Int. Cl.
*G10H 1/04* (2006.01)
*G10H 1/34* (2006.01)

(52) U.S. Cl.
CPC ..... *G10H 1/04* (2013.01); *G10H 1/348* (2013.01); *G10H 2210/195* (2013.01); *G10H 2220/265* (2013.01); *G10H 2230/035* (2013.01)

(58) Field of Classification Search
CPC ..... G10H 2230/035; G10H 2220/265; G10H 2210/195; G10H 1/055; G10H 5/00; G10H 5/02; G10H 2010/155
See application file for complete search history.

(56) References Cited

U.S. PATENT DOCUMENTS 5,432,294 A * 7/1995 Falzarano, Jr. ..... G10H 5/10 84/649
10,601,343 B1 * 3/2020 Lamb ..... H02M 1/088
2008/0310191 A1 * 12/2008 Zhu ..... H03K 5/1532 363/21.04
2018/0090115 A1 * 3/2018 Skillings ..... H02J 7/0063
2021/0209916 A1 * 7/2021 Anzziani ..... G08B 29/20

FOREIGN PATENT DOCUMENTS

JP 2020181115 A * 11/2020

* cited by examiner

*Primary Examiner* — Daniel J Colilla

(57) ABSTRACT

A spontaneous audio tone inducing system, machine, and method of use.

14 Claims, 4 Drawing Sheets

SPONTANEOUS AUDIO TONE INDUCING SYSTEM AND METHOD OF USE

BACKGROUND

Prior Art

Audio signals are commonly manipulated or altered to create desirable results. One category of devices dedicated to this is guitar pedals, also known as effects pedals. Examples of effects pedals include wah-wah pedals, delay pedals, and distortion pedals. Effects pedals are generally low voltage electrical devices that may be powered by a battery or a DC power supply. Effects pedals typically receive an incoming audio signal, such as from an electric guitar or synthesizer, and pass this audio signal through an electronic circuit that alters the audio signal. After that, the modified audio signal is sent to the next audio device in the signal path, such as a guitar amplifier, an audio recorder, or even another effects pedal.

SUMMARY OF THE INVENTION

In accordance with the disclosure a spontaneous audio tone inducing system and method of use. The typical goal of a power supply used to power an effects pedal is to provide stable and low-noise power. It is not desirable for the power supply to waver from a stable state or to inject noise, such as DC ripple. This is because noise from the power supply can find its way into the audio signal path. Therefore, many options for a low-ripple, low noise power supply for an effects pedal are commercially available today.

Many effects pedals operate off of a 9V DC power standard. It is therefore common to use a 9V battery or a 9V DC power supply to supply power to an effects pedal. It is furthermore possible to approximate a 9V DC supply from a larger supply, such as a 12V DC supply, by placing a transistor between the 12V supply and the effects pedal, and rapidly switching the transistor on and off using a technique known as pulse width modulation, or PWM. When the transistor is on, the power flows. When the transistor is off, the power does not flow. The rapid switching of the transistor is done such that the transistor is in the 'ON' state approximately 75% of the time, and 'OFF' approximately 25% of the time, yielding approximately a 9V supply. This is a rough description of a 75% duty cycle.

This rapid on/off switching of the transistor in order to impose a duty cycle upon the power supply is also a common technique used to control the speed of motors. One other parameter of PWM should be discussed, which is PWM frequency. In many applications, it does not matter what the PWM frequency is. However, in some applications, when the PWM frequency is within the human hearing range of approximately 20-20,000 Hz, an audible, pitched tone may arise, even from a motor.

While working on a PWM based power supply for an effects pedal, I noticed an unwanted, pitched whine had appeared in my audio signal. No audio source was plugged into the effects pedal, and the whine did not occur with other power supplies. A little sleuthing allowed me to deduce that the whine was caused by my PWM based power supply. Using a guitar tuner, I was able to determine that the pitch of the audio whine was the same frequency as the PWM frequency I was using. I suspected that to remove this whine, I would need to raise the frequency of the PWM signal above the range of human hearing, approximately 20,000 Hz. Making this change silenced the unwanted whine.

However, it occurred to me that this unwanted whine was alternatively a musical tone that could potentially be controlled and played as an instrument, effectively turning a passive effects pedal into an active tone generating device, requiring no audio input to produce musical audio output. Furthermore, this spontaneous tone could be commingled into any incoming audio signal, combining into fantastic new harmonic interactions.

Playing, for example, an A note on my guitar, while introducing a PWM based A4 switching tone into the power supply of my delay pedal allowed me to produce beat frequencies as I slightly bent the guitar string out of unison with the A4 switching tone. Additionally, modifying the PWM duty cycle while keeping the PWM frequency constant further affected the timbre and amplitude of the induced tone, depending on the effects pedal chosen. For example, a 10% duty cycle A4 switching noise tone induced in an analog delay pedal has a different amplitude and timbre than a 20% duty cycle A4 switching noise tone in the same pedal. Furthermore, similar behaviors were evident across the variety of off-the-shelf pedals I had on hand for testing.

Being able to control the spontaneous induced pitch (PWM frequency), amount of power (PWM duty cycle), concurrently play an instrument, and make settings to the pedal parameters (such as delay time and regeneration), greatly increases the options to further manipulate the audio signal emitted by an off-the-shelf effects pedal.

This discovery reveals significant novel applications for musical performance from the wide variety of currently available effects pedals. This discovery also envisions an emerging role for spontaneous audio tone inducing in new audio signal processing device designs.

DETAILED DESCRIPTION—FIRST EXAMPLE—FIGS. 1, 2

Figure 1:
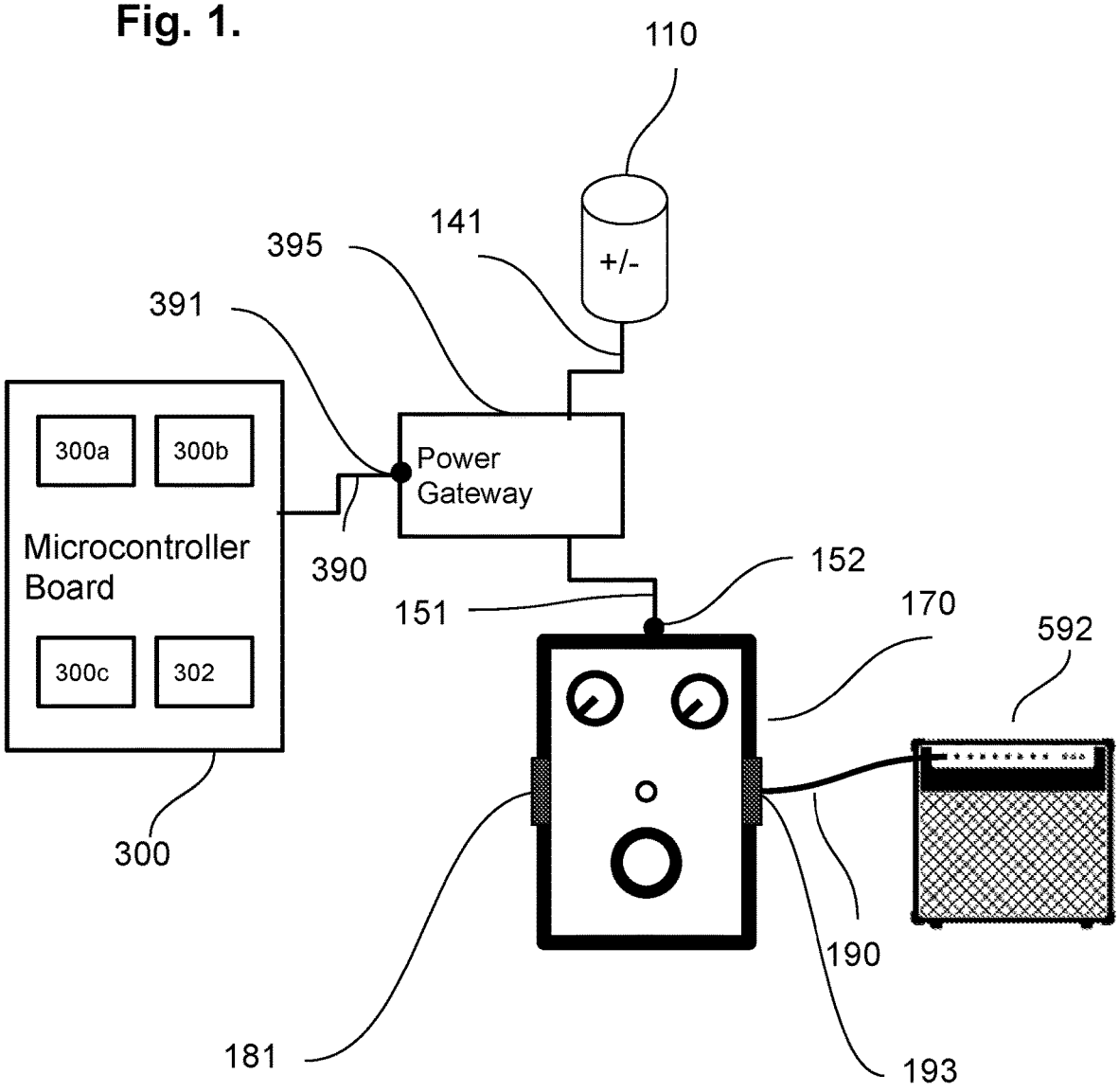
FIG. 1 shows a diagram of various aspects of a spontaneous audio tone inducing system in accordance with the disclosure.
Figure 2:
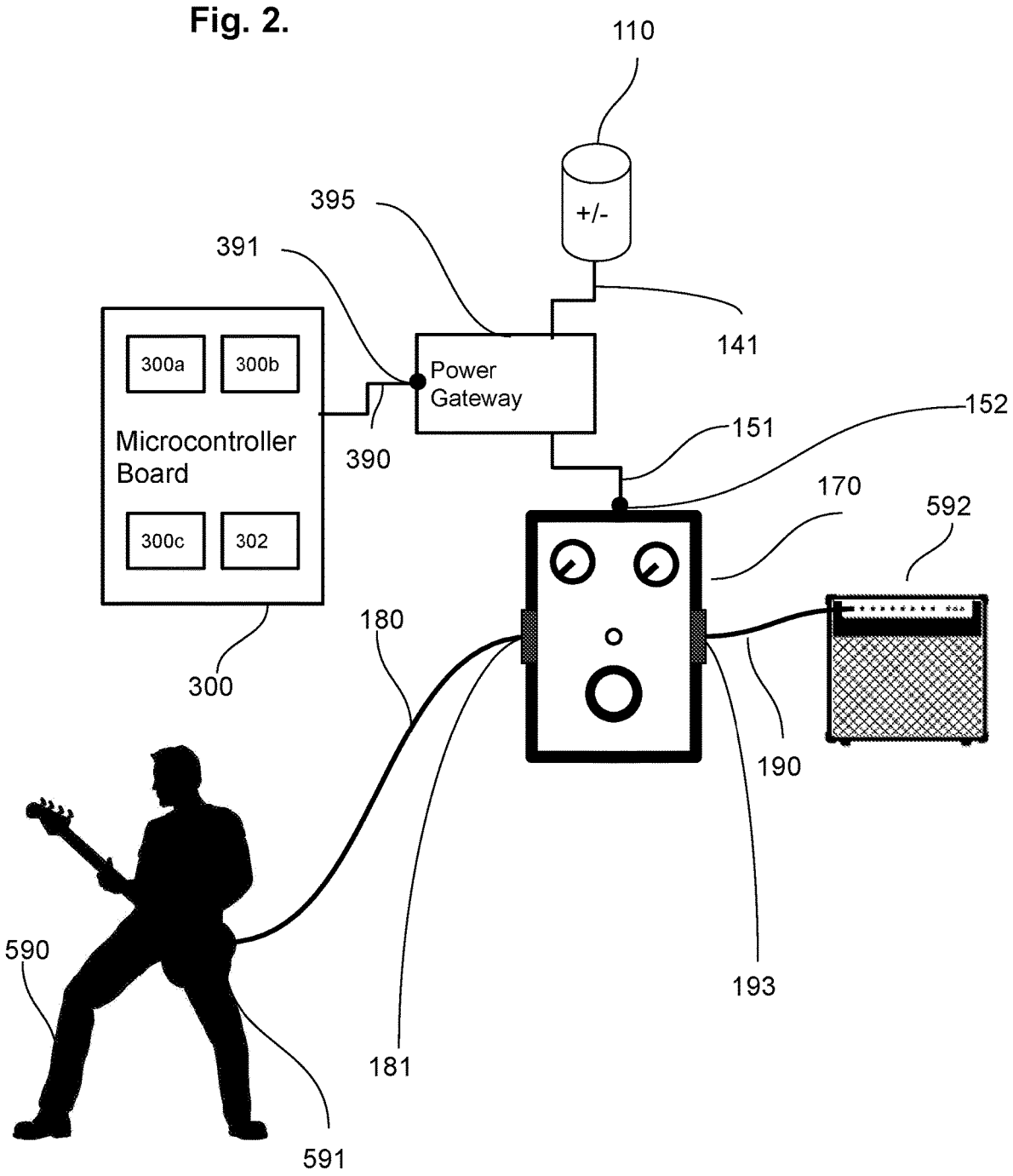
FIG. 2 shows a diagram of various aspects of the spontaneous audio tone inducing system shown in FIG. 1 and a method of use in accordance with this disclosure.

One example of the spontaneous audio tone inducing system is illustrated in FIGS. 1 and 2. The spontaneous audio tone inducing system is an audio signal generating and processing system, comprising a microcontroller board 300, an audio signal processing circuit 170, and a power gateway 395.

There is shown a power supply 110 which is typically a 12-18V DC power supply such as an internal power supply, a battery, or a "wall wart" AC power adapter. The power supply 110 produces an input power 141 which is connected to a power gateway 395.

With continued reference to FIG. 1, the spontaneous audio tone inducing system may also include a microcontroller board 300. The microcontroller board 300 is schematically shown as including a processor 300*a* and a non-transient storage medium or memory 300*b*, such as RAM, flash drive or a hard drive. Memory 300*b* is for storing executable code, the operating parameters, and the input from the operator user interface 302 while processor 300*a* is for executing the code. The electronic controller is also shown as including a transmitting/receiving port 300*c*, such as an Ethernet port for two-way communication with a WAN/LAN related to an automation system. A user interface 302 may be provided to activate and deactivate the system, allow a user to manipulate certain settings or inputs to the microcontroller board 300, and to view information about the system operation.

The microcontroller board 300 typically includes at least some form of memory 300*b*. Examples of memory 300*b* include computer readable media. Computer readable media includes any available media that can be accessed by the processor 300*a*. By way of example, computer readable media include computer readable storage media and computer readable communication media.

Computer readable storage media includes volatile and nonvolatile, removable and non-removable media implemented in any device configured to store information such as computer readable instructions, data structures, program modules or other data. Computer readable storage media includes, but is not limited to, random access memory, read only memory, electrically erasable programmable read only memory, flash memory or other memory technology, compact disc read only memory, digital versatile disks or other optical storage, magnetic cassettes, magnetic tape, magnetic disk storage or other magnetic storage devices, or any other medium that can be used to store the desired information and that can be accessed by the processor 300*a*.

Computer readable communication media typically embodies computer readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. By way of example, computer readable communication media includes wired media such as a wired network or direct-wired connection, and wireless media such as acoustic, radio frequency, infrared, and other wireless media. Combinations of any of the above are also included within the scope of computer readable media.

The microcontroller board 300 is also shown as having a number of inputs/outputs that may be used for implementing the below described methods The microcontroller board 300 connects a control signal 390 to a control signal input 391 of the power gateway 395. A satisfactory example of a control signal 390 in this example is a pulse width modulation (PWM) signal, although other control signals are possible. A satisfactory example of a power gateway 395 is a transistor, although other power gateways are possible.

The transistor 395 connects a modified output power 151 to the power input connection 152 of the audio signal processing circuit 170. The audio signal processing circuit 170 is shown having an input signal connection 181, and an output signal connection 193, from which comes a modified processed output signal 190 which is connected to an audio output device 592. By use of the term "audio output device" it is meant to include any output or capture device having audio capabilities. Non-limiting examples of audio output devices include a speaker, a guitar amplifier, and a piezoelectric element. Non-limiting examples of audio capture devices include a magnetic tape recorder, a digital audio workstation, and a computer. In this example, the audio output device is a guitar amplifier 592.

Operation—FIGS. 1, 2

First, a power supply 110 which is typically a 5-18V DC power supply such as an internal power supply, a battery, or a "wall wart" AC power adapter, emits an input power 141 which is connected to the power gateway 395.

Next, the signal path is connected. In this embodiment, an audio input device 591 emits an unprocessed input signal 180 which then connects to an input signal connection 181 of the audio signal processing circuit 170. By use of the term "audio input device" it is meant to include any input device having audio capabilities. Non-limiting examples of audio input devices include microphones, pre-recorded media players, electric guitars, synthesizers, electronic instruments, electro-mechanical instruments, and digital audio workstations.

In this embodiment, the audio input device is an electric guitar 591. In this embodiment the operator 590 is a guitar player 590. In this embodiment the audio signal processing circuit is an analog delay 170.

The microcontroller board 300 emits a control signal 390 to the control signal input 391 of the power gateway 395. The power gateway 395 opens or closes as a function of the control signal 390. In this embodiment, the control signal is a PWM signal 390 and the power gateway 395 is a transistor.

The user interface 302 is used to configure the PWM signal 390 to a frequency of 440 Hz, and a duty cycle of 10%. The PWM signal 390 causes the transistor 395 to open and close at a rate of 440 times per second (PWM frequency) wherein the open state comprises 10% of each period (PWM duty cycle). Next, the transistor 395 emits the modified output power 151 to the power input connection 152 of the analog delay 170. Because 440 Hz is within the human hearing range of approximately 20 Hz-20,000 kHz, an audible oscillation of 440 Hz arises in the modified processed output signal 190 as a function of the modified output power 151

The electric guitar 591 outputs an unprocessed input signal 180 which arrives at the input signal connection 181 and is then processed by the analog delay 170 and further modified by the modified output power 151. The result is a modified processed output signal 190 which features the 440 Hz spontaneous induced audio tone.

The modified processed output signal 190 exits the analog delay 170 from the output signal connection 193 which is connected to an audio output device 592.

Next, the user interface 302 is manipulated to adjust the PWM duty cycle of the PWM signal 390. I have observed that it is possible to increase the amplitude of the spontaneous induced audio tone by decreasing the PWM duty cycle to an approximately low value, such as 5%-40%. However, decreasing the duty cycle to an even lower value will cause the analog delay 170 to power off and stop passing audio entirely. Conversely, increasing the duty cycle, approximately over 40%, will cause the spontaneous induced audio tone to fall beneath the noise floor or become approximately inaudible.

Next, the user interface 302 is manipulated to select a different frequency for the PWM signal 390 in order to obtain a different musical tone or note. A useful formula for selecting different frequencies for the PWM signal 390 is the following equation which is used to determine the frequency of different piano keys:

$$\text{PWM Frequency}=f(n)=440*(2\hat{}((n-49)/12))$$

In this equation, n is the piano key index; for example, when n=49, the frequency produced by this equation is 440, also known as A4. Choosing values of N from 1 (A0 27.5 Hz) to 88 (C8 4186.01 Hz) will yield useful frequencies for western music. Values of N above 88 and below 1 in the above equation yield extended frequencies beyond the 88-key piano standard and would also be satisfactory. Alternative equations to calculate frequency values for semitone music, equal temper scales, portamento, and pitch wheel data would be satisfactory. Frequency lookup tables, or precalculated frequency values could also be used in place of an equation and would be satisfactory.

Next, the user interface 302 is manipulated to change the PWM frequency of the PWM signal 390 from an audible 440 Hz to a frequency that is approximately above the range of human hearing, such as 25 kHz. The modified output power 151 supplied to the analog delay 170 now effectively silences the spontaneous induced audio tone, showcasing the ordinary performance of the analog delay 170. The user interface 302 toggles the PWM frequency of the PWM signal 390 back and forth between 440 Hz and 25 kHz to achieve an on/off effect for the spontaneous induced audio tone while the guitar player 590 rocks away on the electric guitar 591. Non-limiting examples of a guitar player 590 rocking away include a guitar player 590 strumming power chords, a guitar player 590 tapping, and a guitar player 590 playing pentatonic scales.

Next, the electric guitar 591 is disconnected and the unprocessed input signal 180 is disconnected from the input signal connection 181. The spontaneous induced audio tone is still present in the modified processed output signal 190. This is because the presence of the spontaneous induced audio tone is not contingent on the presence of an unprocessed input signal 180, but is rather contingent on the presence of a modified output power 151. Namely, the self-noise of the analog delay 170 is sufficient to oscillate and produce a 440 Hz tone when presented with the modified output power 151. In this way, the analog delay 170 is transformed into more than a passive audio processing device; it becomes a tone source under the influence of the modified output power 151.

Figure 3:
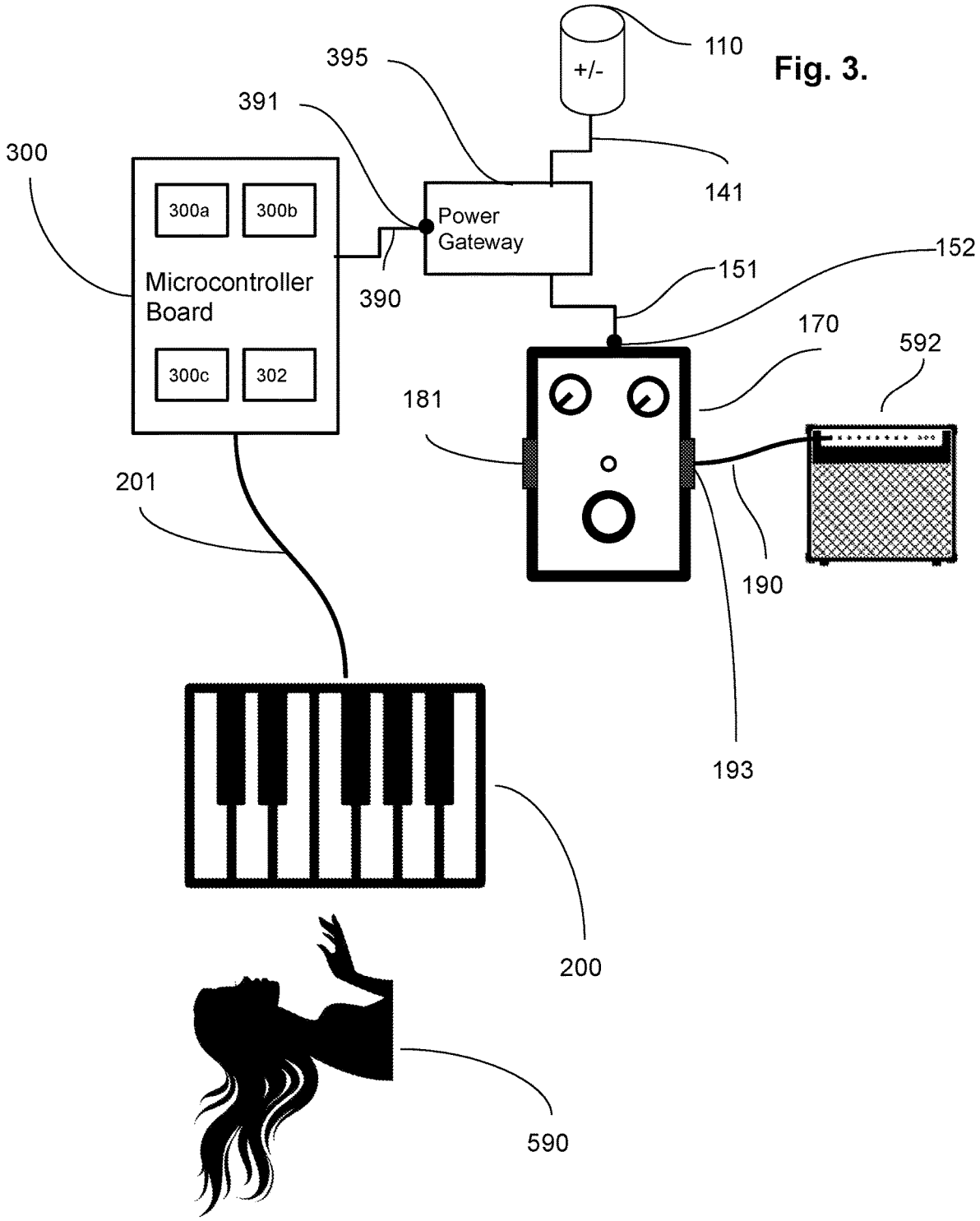
FIG. 3 shows a diagram of a various aspects of a second example of the spontaneous audio tone inducing system and a method of use in accordance with the disclosure.

FIG. 3—Description of Second Example

A second example of the inducer is illustrated in FIG. 3. In the example depicted here, an input controller 200 is connected to an input controller signal output 201 which is connected to the microcontroller board 300. In the example shown here, the input controller signal output 201 is a physical connection, although a wireless connection would also be satisfactory. In this embodiment, the input controller 200 is a MIDI keyboard controller with a modulation wheel 200, although other input controllers are possible and satisfactory.

Operation—FIG. 3

In this example, the operator 590 depresses a key on the MIDI keyboard controller with a modulation wheel 200, and sends a MIDI note on signal to the microcontroller board 300. In this example the operator is a human 590. Other satisfactory non-limiting examples of an operator 590 include a computer, a prerecorded sequence, or a non-human intelligence. The microcontroller board 300 interprets the MIDI note on signal with any accompanying pitch modulation data, such as what is supplied by a pitch wheel, and determines the frequency for the PWM signal 390, inducing the spontaneous audio tone in the modified processed output signal 190.

Next, the human 590 lifts up the keyboard key, and sends a MIDI note off signal to the microcontroller board 300. The microcontroller board 300 interprets the MIDI note off signal, and takes action to silence the induced audio tone. Non-limiting examples of techniques to silence the induced audio tone include setting the PWM frequency of the PWM signal 390 to a value that is approximately higher than the range of human hearing, and setting the PWM duty cycle of the PWM signal 390 to 100%.

Next, the human 590 plays another note on the MIDI keyboard controller with a modulation wheel 200, triggering another MIDI note on signal and a corresponding induced audio tone. While sustaining this note, the human 590 manipulates the modulation wheel. The modulation wheel outputs a value from a range of approximately 0 to 1024 as a function of the position of the wheel. Other ranges are possible and satisfactory. It would also be satisfactory to replace the wheel with another interface, including but not limited to: distance controllers, touchless knobs, or rotary encoders. The modulation wheel value is converted by the microcontroller board 300 into a duty cycle percentage value, and the PWM duty cycle of the PWM signal 390 is set to this duty cycle percentage value. For example, providing a modulation wheel value of 128 in a range of 1-1024 would be a 12.5% duty cycle. The PWM duty cycle has a rising edge and a falling edge. While the position of the rising edge is fixed by the PWM frequency, the falling edge moves as a function of the duty cycle, inducing a "secondary" tone akin to the "primary" tone of the PWM frequency. This secondary tone manifests as timbre wherein changes to the duty cycle result in changes to the harmonic content (such as the overtone series) of the spontaneous induced audio tone fundamental. The human 590 changes the modulation wheel again and alters the timbre of the induced audio tone present in the modified processed output signal 190. The human 590 lifts up the depressed keyboard key.

Next, the human 590 plays a C major triad chord on the MIDI keyboard controller with a modulation wheel 200, triggering three MIDI note on signals. Other chords would be satisfactory. The microcontroller board 300 interprets the three MIDI note on messages and determines a set of three frequency values, one for each of the three depressed keys in the triad. The microcontroller board 300 rotates through each of the three frequencies for the PWM signal 390, thereby inducing each of the three corresponding frequencies, one by one, as the spontaneous audio tone in the modified processed output signal 190.

It would be satisfactory to randomly rotate through each of the three frequencies, or it would be satisfactory to program the duration and duty cycle of each of the three frequencies individually, such as how a sequencer or arpeggiator operates. When the rotation of PWM frequencies is sufficiently rapid, this technique also allows pseudo-polyphony, or the illusion of a chord as opposed to discrete monophonic notes.

Figure 4:
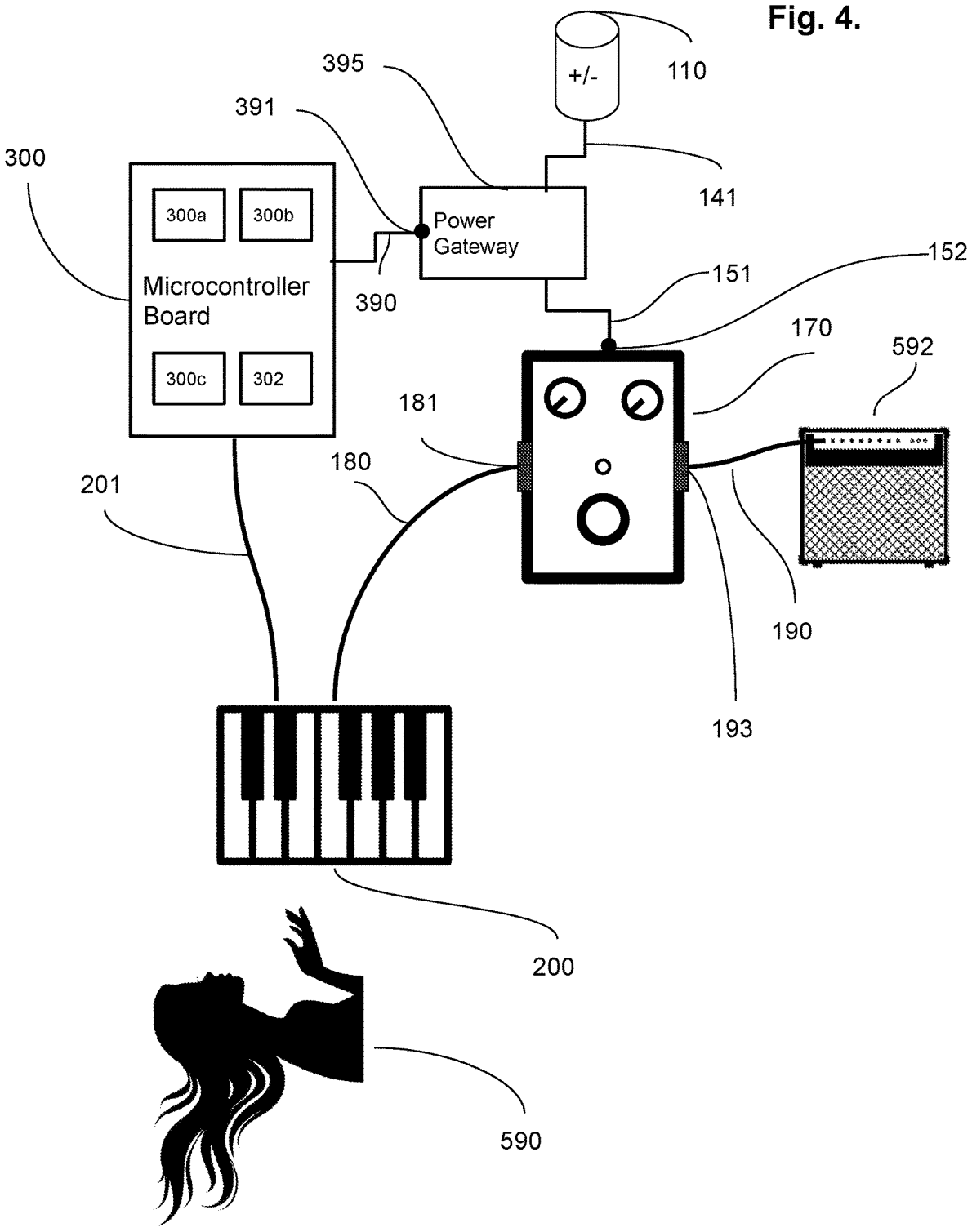
FIG. 4 shows a diagram of a various aspects of a third example of the spontaneous audio tone inducing system and a method of use in accordance with the disclosure.

FIG. 4—Description of Third Example

In this embodiment, the input controller 200 is a synthesizer with MIDI and a modulation wheel 200, although other input controllers are possible and satisfactory. In the example depicted here, the synthesizer with MIDI and a modulation wheel 200 is connected to an input controller signal output 201 which is connected to the microcontroller board 300.

It is common for synthesizers to have both audio and MIDI features, so for convenience, in this embodiment, the synthesizer with MIDI and a modulation wheel 200 is also an audio input device 591 that produces an unprocessed input signal 180 which is connected to the input signal connection 181 of the analog delay 170.

Operation—FIG. 4

In this example, the operator 590 depresses a key on the synthesizer with MIDI and a modulation wheel 200, and sends a MIDI note on signal to the microcontroller board 300. In this example the operator is a human 590. Other satisfactory non-limiting examples of an operator 590 include a computer, a prerecorded sequence, or a non-human intelligence. The microcontroller board 300 interprets the MIDI note on signal, determines a frequency with which to set the PWM frequency of the PWM signal 390, and induces the spontaneous audio tone in the modified processed audio output 190.

Simultaneously, the synthesizer with MIDI and a modulation wheel 591 outputs an unprocessed input signal 180 which arrives at the input signal connection 181 and is then processed by the analog delay 170 and further modified by the modified output power 151. The result is a modified processed output signal 190 which features the commingled content of the audio input device 591 and the spontaneous induced audio tone.

Next, the human 590 lifts up the keyboard key, which silences the unprocessed input signal 180, and sends a MIDI note off signal to the microcontroller board 300. The microcontroller board 300 interprets the MIDI note off signal, and takes action to silence the spontaneous induced audio tone.

Thus the reader will see that the disclosed spontaneous audio tone inducers provide novel ways for performers to exploit their existing effects pedals and signal processing circuits to control previously uncontrollable features and produce previously unheard sounds.

Although unlocking a new feature hidden in today's commercially available effects pedals has broad creative applications, the disclosed embodiments and methods could also be incorporated into new audio signal processor designs.

While my above description contains many specificities, these should not be construed as limitations on the scope, but rather as an exemplification of one [or several] embodiments thereof. Many other variations are possible, including, but not limited to, variations that apply classic audio signal processing techniques to the two tone sources; the first tone source being the spontaneous induced audio tone, and the second tone source being the unprocessed audio signal. Consider a chorus-like effect which is accomplished by detuning the spontaneous induced audio tone against the unison unprocessed input signal. Consider a delay like effect created by introducing the spontaneous induced audio tone 40-2000 milliseconds after the unprocessed input signal. Furthermore, consider techniques that use feedback to return the spontaneous induced audio tone back into the input signal connection for recursive processing by the audio signal processing circuit.

Accordingly, the scope should be determined not by the embodiments illustrated, but by the appended claims and their legal equivalents Drawings—REFERENCE NUMERALS

110 power supply
141 input power
151 modified output power
152 power input connection
170 audio signal processing circuit
180 unprocessed input signal
181 input signal connection
190 modified processed output signal
193 output signal connection
200 input controller
201 input controller signal output
300 microcontroller board
300*a* processor
300*b* non-transient storage medium
300*c* transmitting/receiving port
302 user interface
390 control signal
391 control signal input
395 power gateway
590 operator
591 audio input device
592 audio output device

I claim:

1. A spontaneous audio tone inducing system comprising:

a) an audio signal processing circuit for modifying a signal from an audio input device to an audio output device;

b) a power supply for providing power to the audio signal processing circuit;

c) a power gateway for modifying the flow of power from the power supply to the audio signal processing circuit; and d) a processor for controlling the power gateway as a function of at least one control frequency, whereby the power supply and power gateway, together, generate at least one tone.

2. The spontaneous audio tone inducing system of claim 1 wherein the system includes an input for selecting or modifying the at least one control frequency.

3. The spontaneous audio tone inducing system of claim 1 wherein the processor includes one or more preset parameters and wherein the system includes an input for selecting or modifying the one or more preset parameters.

4. The spontaneous audio tone inducing system of claim 1, wherein the power gateway includes at least one transistor.

5. The spontaneous audio tone inducing system of claim 1, wherein the at least one control frequency is within the range of 10 Hz to 22,000 Hz.

6. The spontaneous audio tone inducing system of claim 1, wherein the processor controls the power gateway with at least pulse width modulation.

7. A machine for inducing a spontaneous audio tone in an audio signal processing circuit, the machine comprising:

a) a power supply configured to provide power to an audio signal processing circuit;

b) a power gateway configured to modify the flow of power from the power supply to the audio signal processing circuit; wherein the power supply and the power gateway, together, generate at least one tone; and c) a processor configured to control the power gateway as a function of at least one control frequency.

8. The machine of claim 7 wherein the power gateway includes at least one transistor.

9. The machine of claim 7 wherein the at least one control frequency is within the range of 10 Hz to 22,000 Hz.

10. The machine of claim 7 wherein the machine includes an input for selecting or modifying the at least one control frequency.

11. The machine of claim 7 wherein the processor includes one or more preset parameters and wherein the machine includes an input for selecting or modifying the one or more preset parameters.

12. The machine of claim 7 wherein the processor controls the power gateway with at least pulse width modulation.

13. A method for inducing a spontaneous audio tone in an audio signal processing circuit, the method comprising:

a) receiving at least one control signal from a processor;

b) modifying an input power to a modified output power as a function of the at least one control signal, wherein the modified output power generates at least one tone;

c) sending the modified output power to an audio signal processing circuit; and d) generating an audio output signal as a function of the modified output power.

14. The method of claim 13 wherein the at least one control signal includes a pulse width modulation signal.

* * * * *